US007018274B2

(12) United States Patent
Muldowney

(10) Patent No.: US 7,018,274 B2
(45) Date of Patent: Mar. 28, 2006

(54) POLISHING PAD HAVING SLURRY UTILIZATION ENHANCING GROOVES

(75) Inventor: Gregory P. Muldowney, Glen Mills, PA (US)

(73) Assignee: Rohm and Haas Electronic Materials CMP Holdings, Inc, Wilmington, DE (US)

( * ) Notice: Subject to any disclaimer, the term of this patent is extended or adjusted under 35 U.S.C. 154(b) by 89 days.

(21) Appl. No.: 10/712,186

(22) Filed: Nov. 13, 2003

(65) Prior Publication Data

US 2005/0107009 A1 May 19, 2005

(51) Int. Cl.
*B24B 1/00* (2006.01)

(52) U.S. Cl. ..... 451/41; 451/282; 451/921; 451/527; 451/583

(58) Field of Classification Search ..... 451/41, 451/285, 287, 921, 527, 526, 528, 533; 438/692
See application file for complete search history.

(56) References Cited

U.S. PATENT DOCUMENTS 5,645,469 A * 7/1997 Burke et al. ..... 451/41
6,093,651 A * 7/2000 Andideh et al. ..... 438/692
6,110,832 A * 8/2000 Morgan et al. ..... 438/692
6,159,088 A * 12/2000 Nakajima ..... 451/527
6,165,904 A * 12/2000 Kim ..... 438/692
6,273,806 B1 * 8/2001 Bennett et al. ..... 451/527
6,354,930 B1 * 3/2002 Moore ..... 451/527
6,520,847 B1 2/2003 Osterheld et al.
6,729,950 B1 * 5/2004 Park et al. ..... 451/528
6,761,620 B1 * 7/2004 Naujok ..... 451/41
2001/0044263 A1 11/2001 Andideh et al.
2002/0137450 A1 9/2002 Osterheld et al.

FOREIGN PATENT DOCUMENTS

EP 1 114 697 A2 7/2001

* cited by examiner

*Primary Examiner*—George Nguyen
(74) *Attorney, Agent, or Firm*—Blake T. Biederman

(57) ABSTRACT

A chemical mechanical polishing pad (200) that includes a polishing layer (204) having a polishing region (208) and containing a plurality of grooves (212) extending at least partially into the polishing region. During polishing, the grooves contain a slurry (236) that facilitates polishing. Each groove includes a plurality of mixing structures (220) configured to cause mixing of slurry located in a lower portion (240) of the groove with slurry located in the upper portion (244) of the groove.

10 Claims, 5 Drawing Sheets

POLISHING PAD HAVING SLURRY UTILIZATION ENHANCING GROOVES

BACKGROUND OF THE INVENTION

The present invention generally relates to the field of chemical mechanical polishing. More particularly, the present invention is directed to a polishing pad having slurry utilization enhancing grooves.

In the fabrication of integrated circuits and other electronic devices, multiple layers of conducting, semiconducting and dielectric materials are deposited onto or removed from a surface of a semiconductor wafer. Thin layers of conducting, semiconducting and dielectric materials may be deposited by a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize workpieces, such as a semiconductor wafer. In conventional CMP, a wafer carrier, or polishing head, is mounted on a carrier assembly. The polishing head holds the wafer and positions the wafer in contact with a polishing layer of a polishing pad within a CMP apparatus. The carrier assembly provides a controllable pressure between the wafer and polishing pad. Simultaneously therewith, a slurry, or other polishing medium, is flowed onto the polishing pad and into the gap between the wafer and polishing layer. To effect polishing, the polishing pad and wafer are moved, typically rotated, relative to one another. The wafer surface is thus polished and made planar by chemical and mechanical action of the polishing layer and slurry on the surface.

Important considerations in designing a polishing layer include the distribution of slurry across the face of the polishing layer, the flow of fresh slurry into the polishing region, the flow of used slurry from the polishing region and the amount of slurry that flows through the polishing zone essentially unutilized, among others. One way to address these considerations is to provide the polishing layer with grooves. Over the years, quite a few different groove patterns and configurations have been implemented. Prior art groove patterns include radial, concentric circular, Cartesian grid and spiral, among others. Prior art groove configurations include configurations wherein the depth of all the grooves are uniform among all grooves and configurations wherein the depth of the grooves varies from one groove to another.

It is generally acknowledged among CMP practitioners that certain groove patterns result in higher slurry consumption than others to achieve comparable material removal rates. Circular grooves, which do not connect to the outer periphery of the polishing layer, tend to consume less slurry than radial grooves, which provide the shortest possible path for slurry to reach the pad perimeter under the force of pad rotation. Cartesian grids of grooves, which provide paths of various lengths to the outer periphery of the polishing layer, hold an intermediate position.

Various groove patterns have been disclosed in the prior art that attempt to reduce slurry consumption and maximize slurry utilization on the polishing layer. For example, U.S. Pat. No. 6,159,088 to Nakajima discloses a polishing pad having grooves that generally force slurry toward the wafer track from both the central portion of the pad and the outer peripheral portion. In one embodiment, each groove has a first portion that extends from the center of the pad radially to the longitudinal centerline of the wafer track. A second portion of each groove extends from the centerline terminus of the first portion to the outer periphery of the pad generally toward the direction of pad rotation. A pair of groove projections is present in each groove at a crotch formed by the intersection of the first and second portions. These projections allow slurry collected at the crotch when the pad is rotated to flow easily to the polishing surface within the wafer track. The Nakajima groove configuration allows fresh slurry flowing in the first portions to mix with "old" slurry flowing in the second portions and be delivered to the wafer track. Other examples of grooves that have been considered to reduce slurry consumption and maximize slurry utilization include, e.g., spiral grooves that are assumed to push slurry toward the center of the polishing layer under the force of pad rotation; zigzag or curved grooves that increase the effective flow resistance and the time required for liquid transit across the pad; and networks of short interconnected channels that retain liquid better under the force of pad rotation than the long straight thoroughfares of a Cartesian grid of grooves.

Research and modeling of CMP to date, including state-of-the-art computational fluid dynamics simulations, have revealed that in networks of grooves having fixed or gradually changing depth, a significant amount of polishing slurry may not contact the wafer because the slurry in the deepest portion of each groove flows under the wafer without contact. While grooves must be provided with a minimum depth to reliably convey slurry as the surface of the polishing layer wears down, any excess depth will result in some of the slurry provided to polishing layer not being utilized, since in conventional polishing layers an unbroken flow path exists beneath the workpiece wherein the slurry flows without participating in polishing. Accordingly, there is a need for a polishing layer having grooves configured in a way that reduces the amount of underutilization of slurry provided to the polishing layer and, consequently, reduces the waste of slurry.

SUMMARY OF THE INVENTION

In one aspect of the invention, a polishing pad useful for polishing a surface of a semiconductor substrate, the polishing pad comprising: (a) a polishing layer having a polishing region configured to polish the surface of a workpiece; and (b) a plurality of grooves located in the polishing layer, each groove: (i) extending at least partially into the polishing region; and (ii) configured for receiving a portion of the polishing solution; at least some of the plurality of grooves each including a plurality of mixing structures configured to mix the polishing solution in that groove.

In another aspect of the invention a method of chemical mechanical polishing a semiconductor substrate, comprising the steps of: (a) providing a polishing solution to a polishing pad that includes a polishing layer having a polishing region and including a plurality of grooves, each groove: (i) having an upper portion and a lower portion; (ii) extending at least partially into the polishing zone; and (iii) receiving a portion of the polishing solution; at least some of the plurality of grooves each including a plurality of mixing structures operatively configured to mix the polishing solution in that groove; (b) engaging the semiconductor substrate with the polishing layer in the polishing region; and (c) rotating the polishing pad relative to the semiconductor substrate to impart a flow into each groove of the plurality of grooves that interacts with at least some mixing structures of the plurality of mixing structures to mix the polishing solution located in the lower portion of that groove with the polishing solution located in the upper portions of that groove.

In another aspect of the invention, a polishing system for use with a polishing solution to polish a surface of a semiconductor substrate, comprising: (a) polishing pad comprising: (i) a polishing layer having a polishing region configured to polish the surface of the semiconductor substrate; and (ii) a plurality of grooves located in the polishing layer, each groove: (A) extending at least partially into the polishing zone; and (B) configured for receiving a portion of the polishing solution; at least some of the plurality of grooves each including a plurality of mixing structures configured to mix the liquid in that groove; and (b) a polishing solution delivery system for delivering the polishing solution to the polishing pad.

DETAILED DESCRIPTION OF THE INVENTION

Figure 1:
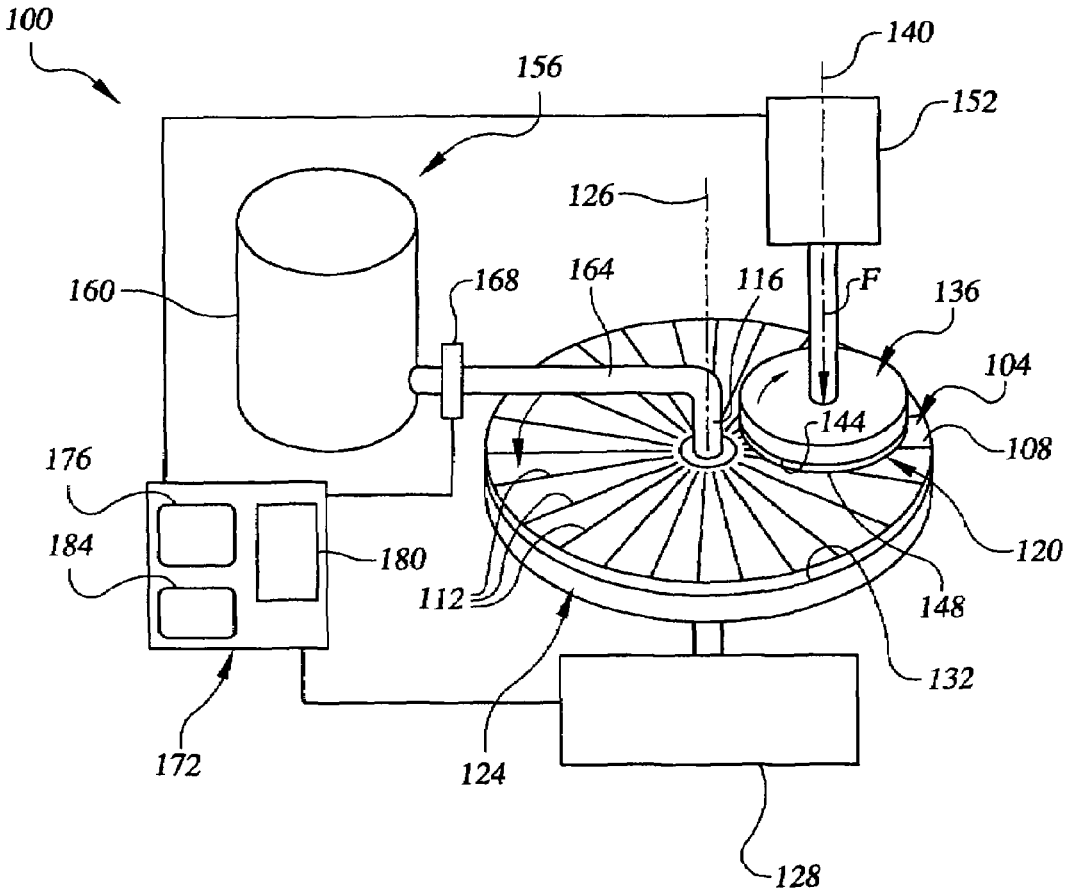
FIG. 1 is a partial schematic diagram and partial perspective view of a chemical mechanical polishing (CMP) system of the present invention.

Referring now to the drawings, FIG. 1 shows in accordance with the present invention a chemical mechanical polishing (CMP) system, which is generally denoted by the numeral 100. CMP system 100 includes a polishing pad 104 having a polishing layer 108 that includes a plurality of grooves 112 configured for enhancing the utilization of a slurry 116, or other liquid polishing medium, applied to the polishing pad during polishing of a semiconductor substrate, such as semiconductor wafer 120 or other workpiece, such as glass, silicon wafer and magnetic information storage disk, among others. For convenience, the term "wafer" is used in the description below. However, those skilled in the art will appreciate that workpieces other than wafers are within the scope of the present invention. Polishing pad 104 and its unique features are described in detail below.

CMP system 100 may include a polishing platen 124 rotatable about an axis 126 by a platen driver 128. Platen 124 may have an upper surface 132 on which polishing pad 104 is mounted. A wafer carrier 136 rotatable about an axis 140 may be supported above polishing layer 108. Wafer carrier 136 may have a lower surface 144 that engages wafer 120. Wafer 120 has a surface 148 that faces polishing layer 108 and is planarized during polishing. Wafer carrier 136 may be supported by a carrier support assembly 152 adapted to rotate wafer 120 and provide a downward force F to press wafer surface 148 against polishing layer 108 so that a desired pressure exists between the wafer surface and the polishing layer during polishing.

CMP system 100 may also include a slurry supply system 156 for supplying slurry 116 to polishing layer 108. Slurry supply system 156 may include a reservoir 160, e.g., a temperature controlled reservoir that holds slurry 116. A conduit 164 may carry slurry 116 from reservoir 160 to a location adjacent polishing pad 104 where the slurry is dispensed onto polishing layer 108. A flow control valve 168 may be used to control the dispensing of slurry 116 onto polishing pad 104.

CMP system 100 may be provided with a system controller 172 for controlling the various components of the system, such as flow control valve 168 of slurry supply system 156, platen driver 128 and carrier support assembly 152, among others, during loading, polishing and unloading operations. In the exemplary embodiment, system controller 172 includes a processor 176, memory 180 connected to the processor and support circuitry 184 for supporting the operation of the processor, memory and other components of the system controller.

During the polishing operation, system controller 172 causes platen 124 and polishing pad 104 to rotate and activates slurry supply system 156 to dispense slurry 116 onto the rotating polishing pad. The slurry spreads out over polishing layer 108, including the gap beneath wafer 120 and polishing pad 104. System controller 172 also causes wafer carrier 136 to rotate at a selected speed, e.g., 0 rpm to 150 rpm, so that wafer surface 148 moves relative to the polishing layer 108. System controller 172 also controls wafer carrier 136 to provide a downward force F so as to induce a desired pressure, e.g., 0 psi to 15 psi, between wafer 120 and polishing pad 104. System controller 172 further controls the rotational speed of polishing platen 124, which is typically rotated at a speed of 0 to 150 rpm.

Figure 2:
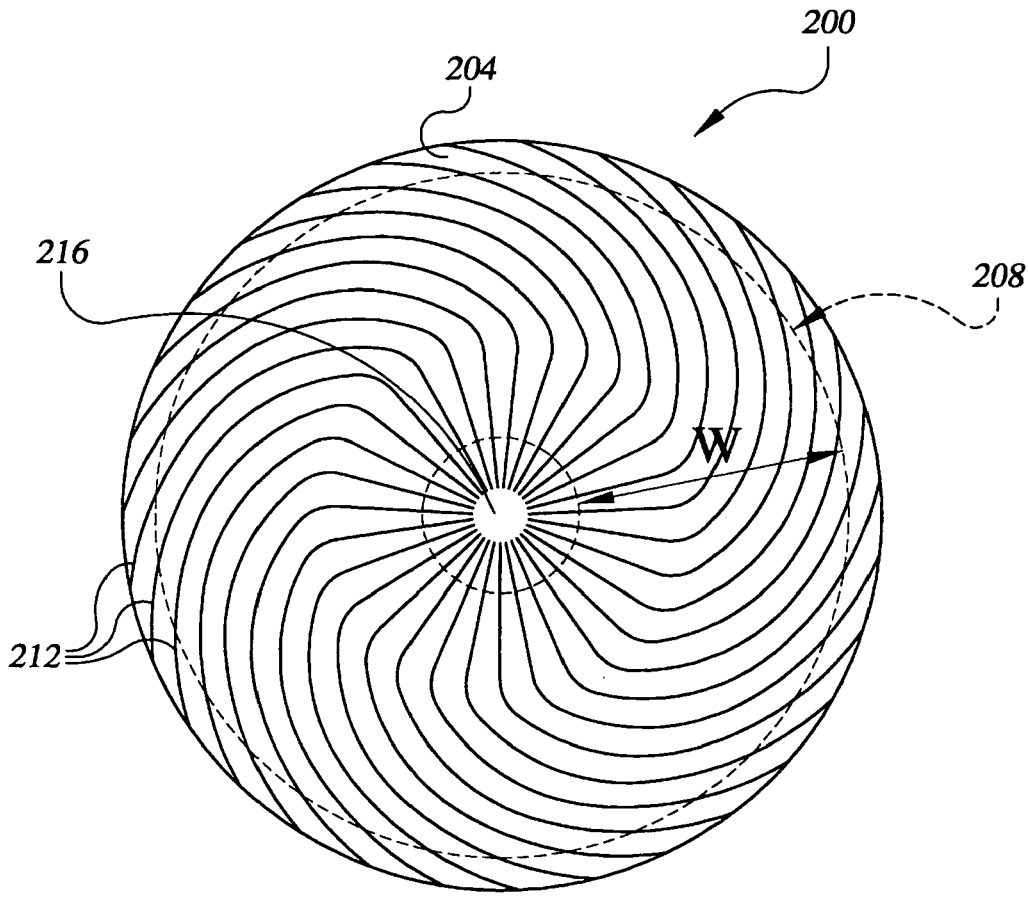
FIG. 2 is a plan view of a polishing pad of the present invention suitable for use with the CMP system of FIG. 1.

FIG. 2 shows an exemplary polishing pad 200 that may be used as polishing pad 104 of FIG. 1 or with other polishing systems utilizing similar pads. Polishing pad 200 includes a polishing layer 204 that contains a polishing region 208, which confronts the surface of a wafer (not shown) during polishing. In the embodiment shown, polishing pad 200 is designed for use in CMP system 100 of FIG. 1, wherein wafer 120 is rotated in a fixed position relative to platen 124, which itself rotates. Accordingly, polishing region 208 is annular in shape and has a width W equal to the diameter of the corresponding wafer, e.g., wafer 120 of FIG. 1. In an embodiment wherein the wafer is not only rotated but also oscillated in a direction parallel to polishing layer 204, polishing region 208 would likewise be annular, but width W would be greater than the diameter of the wafer to account for the oscillation envelope. In other embodiments, polishing region 208 may extend across entire polishing layer 204.

Polishing layer 204 includes a plurality of grooves 212 for enhancing the distribution and flow of slurry (not shown) throughout polishing region 208, among other reasons, such as to increase slurry retention time within the polishing region. In the embodiment shown, grooves 212 are generally curved in shape and may be said to generally radiate outward from a central portion 216 of polishing layer. Although grooves 212 are shown thusly, those skilled in the art will readily appreciate that the underlying concepts of the present invention may be used with grooves defining any shape and pattern within polishing layer 204. For example, grooves 212 may be any one of the other shapes discussed above in the background section, i.e., the radial, circular, Cartesian grid and spiral, to name a few.

Polishing pad 200 may be of any conventional or other type construction. For example, polishing pad 200 may be made of a microporous polyurethane, among other materials, and optionally include a compliant or rigid backing (not shown) to provide the proper support for the pad during polishing. Grooves 212 may be formed in polishing pad 200 using any process suitable for the material used to make the pad. For example, grooves 212 may be molded into polishing pad 200 or cut into the pad after the pad has been formed, among other ways. Those skilled in the art will understand how polishing pad 200 may be manufactured in accordance with the present invention.

Figure 3A:
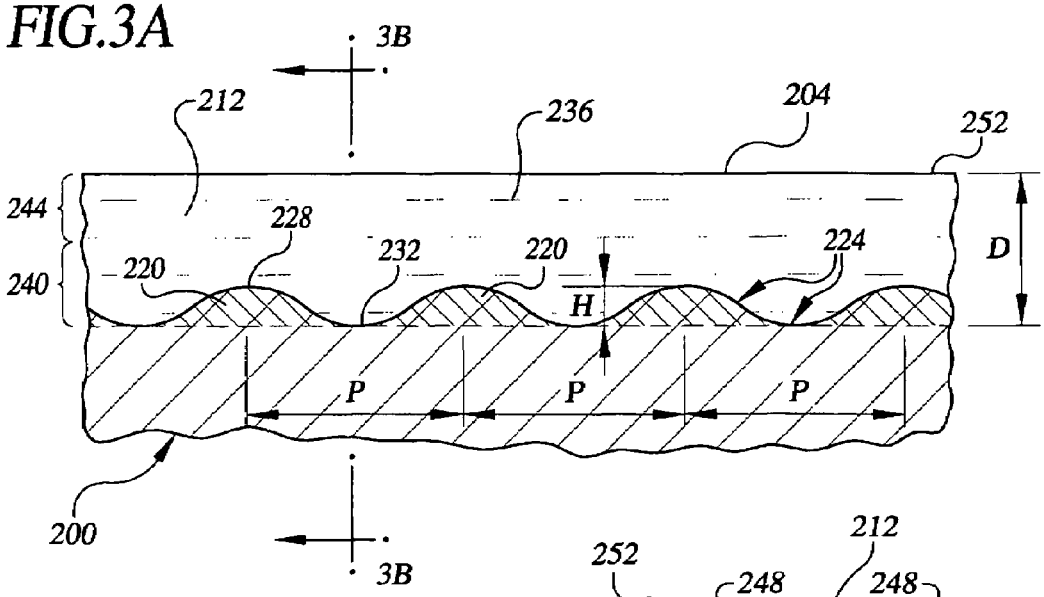
FIG. 3A is an enlarged cross-sectional view of the polishing pad of FIG. 2 as taken along the longitudinal centerline of one of the grooves showing a plurality of mixing structures arranged within the groove.

FIG. 3A shows a longitudinal cross-sectional view through one of grooves 212 of polishing pad 200 of FIG. 2. Groove 212 includes a plurality of mixing structures 220 (indicated generally by additional hatching) located along the length of the groove so as to defining the bottom 224 of the groove. In general, mixing structures 220 define a series of peaks 228 (or, as mentioned below, plateaus) and valleys 232 that disturb the flow of slurry 236 in a lower portion 240 of the groove by an amount sufficient to inhibit the stratification of this flow. When mixing structures 220 are properly shaped and sized, this disturbance causes some measure of mixing between slurry 236 in an upper portion 244 of groove 212 and the slurry in lower portion 240 of the groove.

Figure 3B:
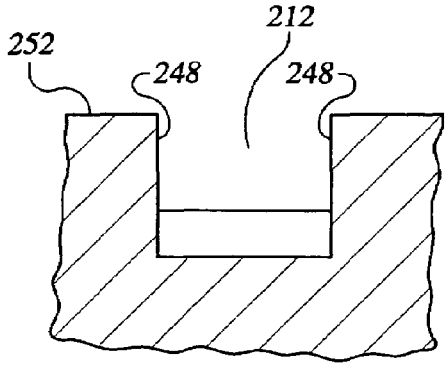
FIG. 3B is a cross-sectional view of the polishing pad of FIG. 2 as taken along line 3B—3B of FIG. 3A.

If mixing structures 220 were not present, as discussed in the background section above, slurry 236 in upper portion 244 of groove 212 would actively participate in polishing, whereas the slurry in lower portion 240 of the groove would typically pass out of the polishing region 208 (FIG. 2) by the action of centrifugal force due to the rotation of polishing pad 200 and the relative motions of the polishing pad 200 and the wafer, e.g., wafer 120 of FIG. 1, without actively participating in the polishing. However, with mixing structures 220 present, the disturbance induced thereby causes slurry 236 from upper and lower portions 244, 240 of groove 212 to mix with one another. That is, the disturbance mixes "used" slurry 236 from upper portion 244 and "fresh" slurry from lower portion 240 so that more fresh slurry has the opportunity to actively participate in polishing and the resulting steady-state concentration of active chemical species in the slurry immediately adjacent to the wafer surface is higher. As shown in FIG. 3B, groove 212 includes spaced apart walls 248, which may be perpendicular to surface 252 of polishing layer as shown or, alternatively, may form an angle other than 90° with the surface. Also, as shown in FIG. 3B, groove 212 may have a bottom that is substantially parallel to surface 252 or, alternatively, may form a nonzero angle with the surface.

Figure 3C:
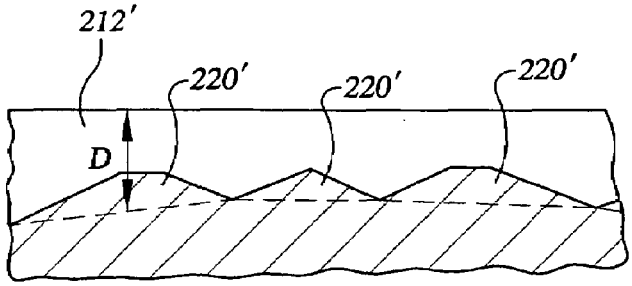
FIG. 3C is an enlarged longitudinal cross-sectional view of the groove wherein the groove includes a plurality of alternative mixing structures arranged within the groove.
Figure 3D:
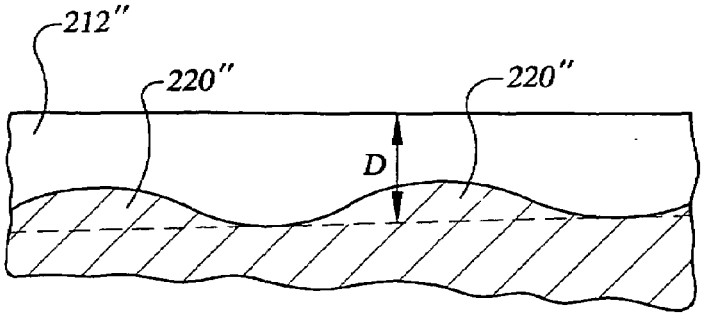
FIG. 3D is an enlarged longitudinal cross-sectional view of the groove wherein the groove includes a plurality of mixing structures and a nominal depth that varies linearly along the length of the groove.

Referring again to FIG. 3A, mixing structures 220 may be defined relative to a nominal depth D of groove 212. Nominal depth D is the vertical distance between surface 252 of polishing layer 208 and a line obtained by connecting the lowest point on each valley 232 to the lowest point on each immediately adjacent valley. In the example of FIG. 3A, it is seen that the lowest points on all valleys 232 are at the same distance from surface 252 of polishing layer 208. Consequently, nominal depth D is uniform along the length of groove 212. However, as shown in FIG. 3C, nominal depth D of groove 212' may vary, depending upon the configurations of mixing structures 220' used. FIG. 3D illustrates how nominal depth D can vary linearly along the length of groove 212" in the presence of a plurality of uniformly sized and pitched mixing structures 220". Those skilled in the art will readily appreciate the many ways nominal depth D may vary depending upon the selection and use of variously sized and shaped mixing structures.

Mixing structures, e.g., mixing structures 220 of FIG. 3A, are generally most effective when their height H (FIG. 3A) relative to nominal depth D falls within a certain range and the pitch P of the mixing structures along groove 212 is within a certain range. These ranges vary with the shapes of mixing structures 220 and the resulting valleys 232. Since there are many possible shapes, it is not practical to provide exact ranges, but rather general design principals. Generally, height H of mixing structures 220 must be great enough to effect at least some mixing, but not great enough that valleys 232 are so deep that flow separates and stagnates there. Pitch P of mixing structures 220 must be large enough that valleys 232 experience flow, but small enough that mixing of fresh and used slurry is not trivial and occurs along a significant length of groove 212. In one embodiment wherein mixing structures 220 provide bottom 224 of groove 212 with a sinusoidal, periodic cross-sectional shape as shown in FIG. 3A, height H and pitch P of mixing structures 220 expected to result in good mixing capability are 10% to 50% of nominal depth D for height and one to four times nominal depth D for pitch P and preferably 15% to 30% of nominal depth D for height. Those skilled in the art will understand that these ranges are merely exemplary and do not exclude other ranges.

In addition, it is noted that while mixing structures 220 are shown as being periodic and identical to one another, this need not be so. Rather, pitch P, height H, shape, or any combination of these, of mixing structures 220 may vary. Furthermore, while mixing structures 220 will typically be provided along the entire length of groove 212, they may be provided in one or more specific regions wherein mixing of slurry 236 is most desired. For example, mixing structures 220 may be present only in polishing region 208 of polishing layer 204. Similarly, although all grooves 212 on polishing pad 200 may be provided with mixing structures 220, this need not be so. If desired, only certain ones of grooves 212 of polishing pad 200 of FIG. 2, may be provided with mixing structures 220. For example, relative to grooves 212 of FIG. 2, every other groove or every third groove may not be provided with mixing structures 220, among other possibilities.

Figure 4A:
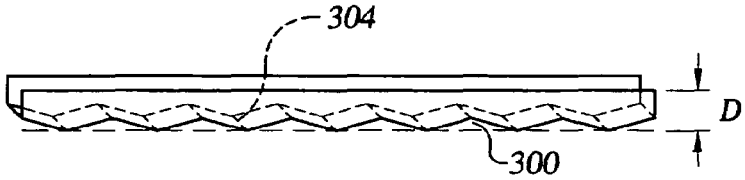
FIGS. 4A–4G are perspective views of polishing pad grooves of the present invention illustrating various alternative mixing structures.
Figure 4B:
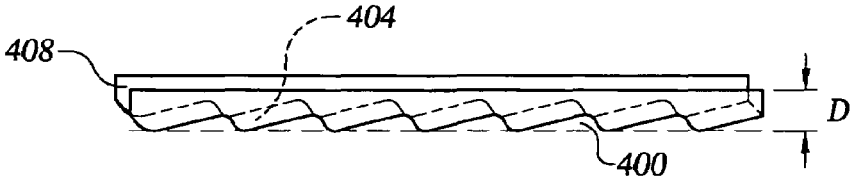
Figure 4C:
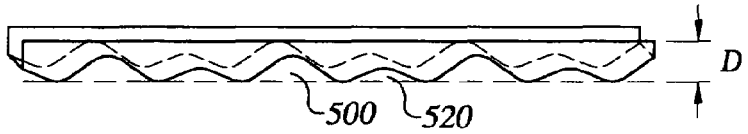
Figure 4D:
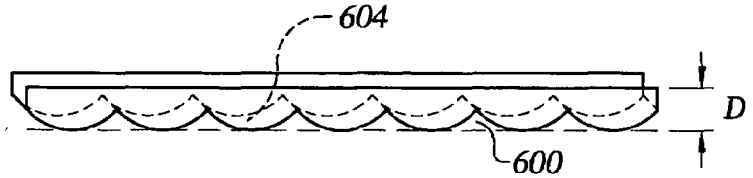
Figure 4E:
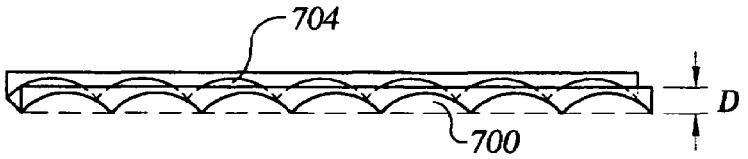
Figure 4F:
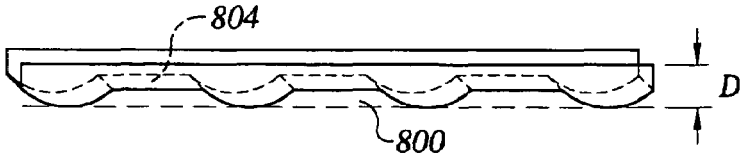
Figure 4G:
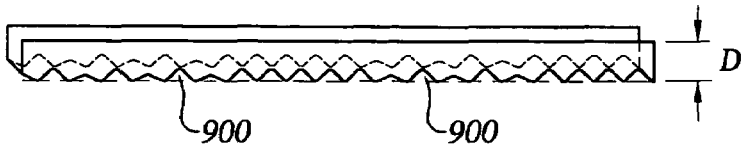

FIGS. 4A–4G show a sample of alternative shapes that may be used for mixing structures within the grooves of polishing pads, e.g., polishing pads 104, 200 of FIGS. 1 and 2, respectively. In FIG. 4A, each mixing structure 300 is triangular so as to form generally V-shaped valleys 304. FIG. 4B shows each mixing structure 400 as being skew-sawtooth-shaped so as to impart a pattern of unequal ascending and descending slopes to bottom 404 of groove 408. FIG. 4C shows hill-shaped mixing structures 500, 520 having two heights that alternate with one another. Mixing structures 600 of FIG. 4D are shaped so as to define scallop-shaped valleys 604. Mixing structures 700 of FIG. 4E each have an arch-shaped upper surface 704. Mixing structures 800 of FIG. 4F are generally trapezoidal in shape so as to define plateaus 804. FIG. 4G shows mixing structures 900 having shapes that are somewhat random among the mixing structures. Regarding the various shapes that may be used for the mixing structures of the present invention, it is desirable, but not necessary, that transitions from peaks to valleys be smooth rather than abrupt. Similarly, it is desirable, but not necessary that the transitions at the bottoms of valleys likewise be smooth and not abrupt.

Figure 5A:
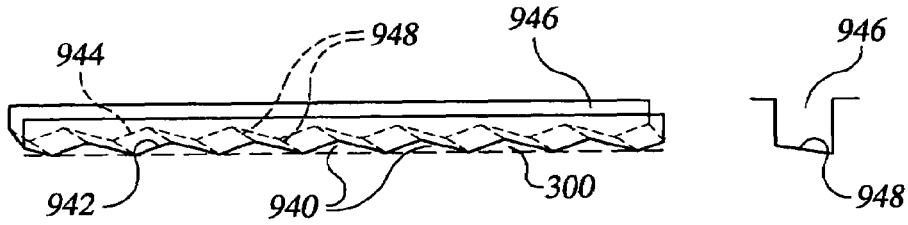
FIGS. 5A–5C are perspective and corresponding cross-sectional views of polishing pad grooves of the present invention illustrating various more complex mixing structures.
Figure 5B:
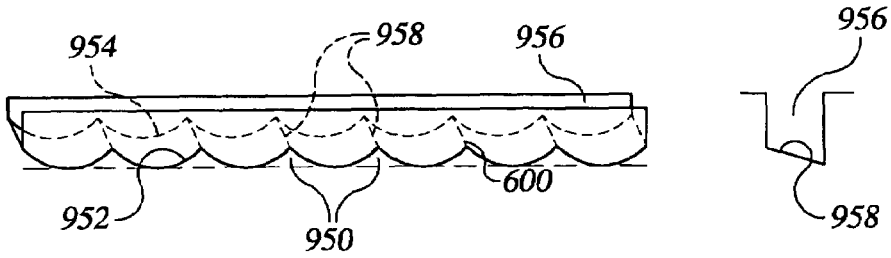
Figure 5C:
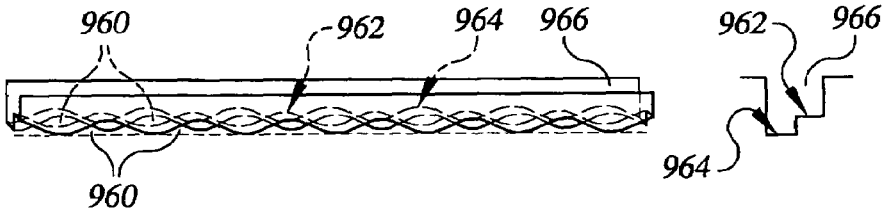

FIGS. 5A–5C show a sample of additional alternative shapes that may be used for mixing structures within the grooves of a polishing pad of the present invention, e.g. grooves 112, 212 of polishing pads of FIGS. 1 and 2, respectively, in particular mixing structures having a height H that varies not only with distance along the groove, but also with distance across the groove. FIG. 5A shows mixing structures 940 that result when two identical geometries 942, 944 (where the sides of groove 946 meet the bottom of the groove) are shifted relative to one another along the length of the groove and connected by straight lines 948 at their corresponding points. FIG. 5B shows mixing structures 950 that result when two identical geometries 952, 954 are shifted relative to one another along the depth of groove 956 and connected by straight lines 958 at their corresponding points. FIG. 5C shows mixing structures 960 formed as two distinct sets 962, 964 of structures occupying opposites sides of groove 966 such that, in general, the cross-sectional shape of the groove has a discontinuity in height.

What is claimed is:

1. A polishing pad useful for polishing a surface of a semiconductor substrate, the polishing pad comprising:

(a) a polishing layer having a polishing region configured to polish the surface of a workpiece; and (b) a plurality of grooves located in the polishing layer, each groove:

(i) extending at least partially into the polishing region; and (ii) configured for receiving a portion of the polishing solution;

at least some of the plurality of grooves each including a plurality of mixing structures configured to mix the polishing solution in that groove, the plurality of mixing structures including a series of peaks and valleys.

2. The polishing pad according to claim 1, wherein ones of the plurality of mixing structures in each corresponding respective groove of the plurality of grooves have a periodic pitch.

3. The polishing pad according to claim 2, wherein ones of the plurality of mixing structures in each corresponding respective groove of the plurality of grooves have the same shape as one another.

4. The polishing pad according to claim 1, wherein each grove of the plurality of grooves containing ones of the plurality of mixing structures has a nominal depth and the periodic pitch is equal to the nominal depth to four times the nominal depth.

5. The polishing pad according to claim 1, wherein each groove of the plurality of grooves containing ones of the plurality of mixing structures has a nominal depth and the ones of the plurality of mixing structures in that groove have a height equal to 10% to 50% of the nominal depth of that groove.

6. A method of chemical mechanical polishing a semiconductor substrate, comprising the steps of:

(a) providing a polishing solution to a polishing pad that includes a polishing layer having a polishing region and including a plurality of grooves, each groove:

(i) having an upper portion and a lower portion;

(ii) extending at least partially into the polishing zone; and (iii) receiving a portion of the polishing solution;

at least some of the plurality of grooves each including a plurality of mixing structures operatively configured to mix the polishing solution in that groove, the plurality of mixing structures including a series of peaks and valleys;

(b) engaging the semiconductor substrate with the polishing layer in the polishing region; and (c) rotating the polishing pad relative to the semiconductor substrate to impart a flow into each groove of the plurality of grooves that interacts with at least some mixing structures of the plurality of mixing structures to mix the polishing solution located in the lower portion of that groove with the polishing solution located in the upper portions of that groove.

7. The method according to claim 6, wherein the polishing pad has a central region and step (a) includes providing the polishing solution proximate the central region.

8. The method according to claim 6, further including the step of providing the polishing pad, wherein each groove of the plurality of grooves containing ones of the plurality of mixing structures has a nominal depth and a periodic pitch; and the periodic pitch is equal to the nominal depth to four times the nominal depth.

9. The method according to claim 6, further including the step of providing the polishing pad, wherein each groove of the plurality of grooves containing ones of the plurality of mixing structures has a nominal depth and the ones of the plurality of mixing structures in that groove have a height equal to 10% to 50% of the nominal depth of that groove.

10. A polishing system for use with a polishing solution to polish a surface of a semiconductor substrate, comprising:

(a) a polishing pad comprising:

(i) a polishing layer having a polishing region configured to polish the surface of the semiconductor substrate; and (ii) a plurality of grooves located in the polishing layer, each groove:

(A) extending at least partially into the polishing zone; and (B) configured for receiving a portion of the polishing solution;

at least some of the plurality of grooves each including a plurality of mixing structures configured to mix the liquid in that groove, the plurality of mixing structures including a series of peaks and valleys; and (b) a polishing solution delivery system for delivering the polishing solution to the polishing pad.

* * * * *